US006049306A

United States Patent [19]

Amarillas

[11] Patent Number: 6,049,306

[45] Date of Patent: Apr. 11, 2000

[54] SATELLITE ANTENNA AIMING DEVICE FEATURING REAL TIME ELEVATION AND HEADING ADJUSTMENT

[76] Inventor: Sal Amarillas, 6048 Cornerstone Ct. West, Ste E, San Diego, Calif. 92121

[21] Appl. No.: 08/781,606

[22] Filed: Jan. 4, 1997

Related U.S. Application Data

[60] Provisional application No. 60/009,606, Jan. 4, 1996.

[51] Int. Cl.[7] ..... H01Q 3/00

[52] U.S. Cl. ..... 342/359

[58] Field of Search ..... 343/711, 712, 343/713, 714, 761, 763, 765, 766, 781, 782, 840, 880, 881, 882, 359

[56] References Cited

U.S. PATENT DOCUMENTS 5,337,062 8/1994 Sherwood et al. ..... 343/711

*Primary Examiner*—William Oen
*Attorney, Agent, or Firm*—Donn K. Harms

[57] ABSTRACT

An satellite antenna aiming device for continuous real time adjustment of the elevation and direction of a satellite antenna to receive the optimum signal to and from a desired satellite. The Device features motor driven gears for horizontal and vertical adjustment of the antenna to the proper desired elevation and direction. The aim of the antenna is controlled by an on board computer programmed to use information from one or all of a number of position communicating devices including an accelerometer, a keypad for entering pre determined position codes, an magnetometer, or a global positioning locator or GPS device. Software containing logarithms using information from the positioning devices calculate the optimum elevation and direction for the antenna to communicate with the satellite and activate the motors to adjust the satellite.

15 Claims, 3 Drawing Sheets

SATELLITE ANTENNA AIMING DEVICE FEATURING REAL TIME ELEVATION AND HEADING ADJUSTMENT

This application claims the benefit of U.S. Provisional Application No. 60/009,606 filed Jan. 4, 1996.

SUMMARY OF THE INVENTION

The present apparatus comprises a means for the automatic aiming of an antenna at an earth orbiting communications satellite for the purposes of receiving data transmitted by such satellites and for transmitting data to such satellites. Real time corrections for movement of the antenna are provided by constant position adjustments controlled by a preprogrammed onboard microprocessor.

A preferred embodiment of the apparatus features a relatively flat stepped rectangular antenna or conventional parabolic dish antenna rotatably mounted upon antenna support housings. The antenna support housings are mounted upon a base support member which is rotatably mounted to a base plate.

The rotation of the antenna support housings and connected base support member is accomplished by a conventional electric motor which when energized rotates and moves a conventional chain or direct drive gear which rotates a gear which is attached to the base support member. When the base support member is thus rotated, the attached antenna support housings rotate concurrently rotating the antenna mounted therein to the proper heading required for satellite communication.

In this preferred embodiment a stable mount for the base support member and attached antenna support housings is achieved through multiple freely rotatably concave hub guides which are mounted to the bottom of the base support member and which ride upon the circumference of a round gear hub mounted to a base plate.

Rotation of the antenna which is mounted in the antenna support housings and base plate to the proper elevation for desired satellite communication is accomplished by energizing an electric motor with drive gear attached which in turn rotates a gear attached to the axis of the rotatably mounted antenna. This can also be accomplished by direct drive of gear on gear or by direct attachment to the motor. The antenna elevation changes when the electric motor rotates the communicating gears thus rotating the antenna. Once power is removed, the two gears cease rotation and lock the antenna in its elevated position.

Power to both electric motors which rotate the antenna for proper elevation and which rotate the base support of the antenna to achieve proper directional aim or heading is provided by a conventional type servo control board attached to conventional power sources such as a battery or transformer powered by alternating current. The servo control board is controlled by a conventional microprocessor capable of storing software programming and algorithms. The microprocessor is preprogramed to energize the two motors to achieve the direction or heading and elevation required to properly aim the antenna to communicate with the desired earth orbiting satellite for either Direct Broadcast Satellite Signals (DBS), Telephone, digital or other satellite communication.

The antenna in this embodiment also features a VHF/UHF antenna element for local television channel reception which can also be rotated and elevated to achieve local optimum local television reception.

In automatic operation, when activated, and with all on board electronic devices powered by a conventional power source, the device functions using a conventional microprocessor which receives heading, pitch, and roll data from a conventional magnetometer or accelerometer mounted on the apparatus. The microprocessor also receives data in the form of a keypad entry from the user as to the desired satellite and the approximate apparatus location on the earth's surface from a number or letter coded map grid which is provided to the user. Or, optionally, a Global Positioning Satellite (GPS) signal from a GPS device as to the apparatus's longitudinal and latitudinal location on the earth's surface can be used in place of the user entered map grid location.

Using the data regarding the antenna location and heading on the earth's surface provided from the magnetometer and/or accelerometer and also from the user entered information as to the desired satellite and estimated antenna apparatus location from a provided map grid and/or from the optional GPS location information, the preprogrammed microprocessor calculates the correct elevation of the antenna, and directional rotation of the base support for the antenna to be properly aimed at the desired earth orbiting satellite for the desired communication therewith.

An elevation potentiometer or other conventional registering device in communication with the antenna axis communicates with both the servo control board and the communicating microprocessor the actual elevation of the antenna in real time. An azimuth potentiometer or other conventional position registration device in communication with the base support also communicates with both the servo control board and microprocessor the direction the base support is pointing in real time.

The microprocessor using on board preprogrammed software and algorithms, takes into consideration the map codes and/or GPS position and satellite choices of the user, the data from the conventional magnetometer and/or accelerometer and calculates and then communicates to the servo control the desired readings from both potentiometers at the point which the proper antenna direction and elevation are reached for the desired communication. The servo control board therein energizes one or both of the electric motors to achieve the desired direction and elevation of the antenna as confirmed by the real-time data provided by both potentiometers.

The microprocessor and servo unit, by continually measuring the output from the two potentiometers can monitor the azimuth or direction and elevation in which the antenna is pointed in real time. Once the proper elevation and direction of the antenna to communicate with the desired satellite is reached, as signaled by the two potentiometers, the motors are de-energized locking the antenna in the proper position for communication with the desired satellite.

A signal strength meter continually updates the microprocessor as to signal strength being received from the satellite. If the signal strength drops below a preprogramed minimum, the preprogrammed microprocessor will direct the antenna to re-aim at the desired satellite to receive the strongest signal possible. By allowing for a variance in the received signal to a predetermined minimum, constant and continuing adjustments of the antenna elevation and direction are minimized.

In addition, real time information regarding heaving, pitch, and roll of the antenna, is continually provided to the microprocessor by the on board magnetometer and/or the accelerometer and/or the conventional GPS positioning device. In a rocking marine environment, this information would be used by the microprocessor in conjunction with preprogrammed software and algorithms to direct the servo unit to adjust the heading and elevation of the antenna though control of the respective electric motors controlling direction and elevation of the antenna. Such adjustments to the proper position for communication would be confirmed by readings from the potentiometers. This real time information provided by the magnetometer, accelerometer and GPS unit allows for continual adjustment of the elevation and direction of the antenna on a rocking boat or moving vehicle to maintain continual communication with the desired satellite.

The antenna is a low profile, high gain, antenna able to receive Direct Broadcast Signals (DBS) from satellites and/or receive and transmit telephone signals from telephone satellites by using a broad band or multiple radiators or signal receivers attached to the antenna at the proper focal point on the antenna. Local or, off air, television channels can also be received through an off air UHF/VHF antenna incorporated into the antenna face. Conventional low noise amplifiers for the received signals may be used as required.

This use of a low profile, flat compact antenna provides for a compact, sturdy, antenna which is aesthetically pleasing. However, a standard parabolic dish antenna would function with the antenna aiming apparatus.

The multiple signals are fed to a multiplexer through one conventional coaxial cable thus alleviating the need for multiple wires to carry the different signals. A conventional slip ring type device allows for the rotation of both the antenna and the base support member while maintaining the connections between the antennas and the multiplexers through the coaxial cable connecting them.

The first multiplexer feeds the received signals through the coaxial cable to a second multiplexer which re-divides the signals and feeds them to the appropriate television, telephone, or DBS receiver requiring a signal.

In a transmit mode, signals would be fed to the second multiplexor, through the coaxial cable to the first multiplexor and broadcast to the desired satellite. Such signals would normally be telephone communications however modem and digital communications are also possible depending upon the receiving satellite.

Further objects of the apparatus will be brought out in the following part of the specification, wherein detailed description is for the purpose of fully disclosing the invention without placing limitations thereon.

BRIEF DESCRIPTION OF DRAWING FIGURES

DETAILED DESCRIPTION OF PREFERRED EMBODIMENTS OF THE INVENTION

Figure 1:
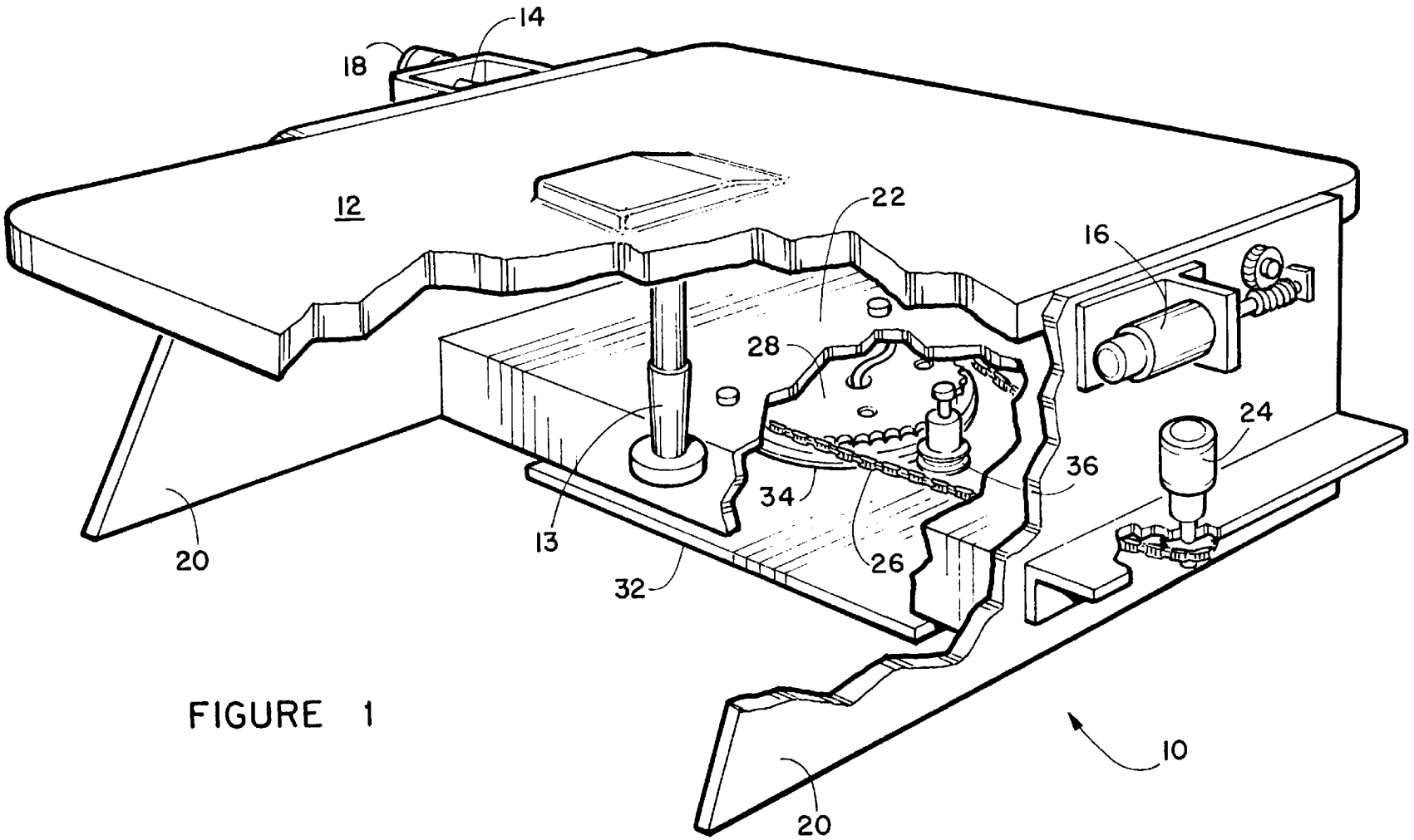
FIG. 1 is view of the apparatus showing the antenna in a stored condition parallel to the base support member.

Referring now to the drawing figures:

FIG. 1 is a preferred embodiment of the apparatus 10 featuring the satellite reception/transmission antenna 12 in its stored or folded condition having a signal reception device 13 mounted on its face. Antenna axis 14 protrudes through each of two antenna support housings 20 providing a rotational mount for the antenna 12.

An elevation motor 16 which is a conventional electric motor has a gear drive which communicates with a gear attached to the antenna axis 14. When energized the elevation motor 16 rotates the communicating gears and adjusts the elevation of the antenna 12. An elevation sensor such as a conventional potentiometer 18 provides constant real time data regarding the elevation position of the antenna 12 to a conventional microprocessor unit 38.

The antenna support housings 20 are mounted to the base support member 22. A second conventional electric motor serves as the azimuth electrical motor 24 and in this embodiment has a gear drive mounted upon it. The gear drive engages a chain 26 which in turn engages the base support gear 28 which is mounted to the bottom of the base support member. Three freely rotatable concave hub guides 36 are also mounted to the bottom of the base support member and hold the base support member 22 in a freely rotatable position above the base plate 32 by engaging the circumference of a circular hub 34 which is mounted upon the base plate 32.

When energized, the azimuth electric motor 24 rotates and moves the chain 26 which rotates the base support gear 28 thus rotating the base support member 22 upon the freely rotatable concave hub guides 36 which ride the circumference of the circular hub 34 mounted upon the base plate 32 thus providing directional rotation to the antenna 12. Bearings would be used as necessary inside the concave hub guides 36 to maintain ease of rotation. An azimuth sensor 30 which is a conventional potentiometer provides constant real time information about the azimuth or direction the antenna is pointed.

Figure 2:
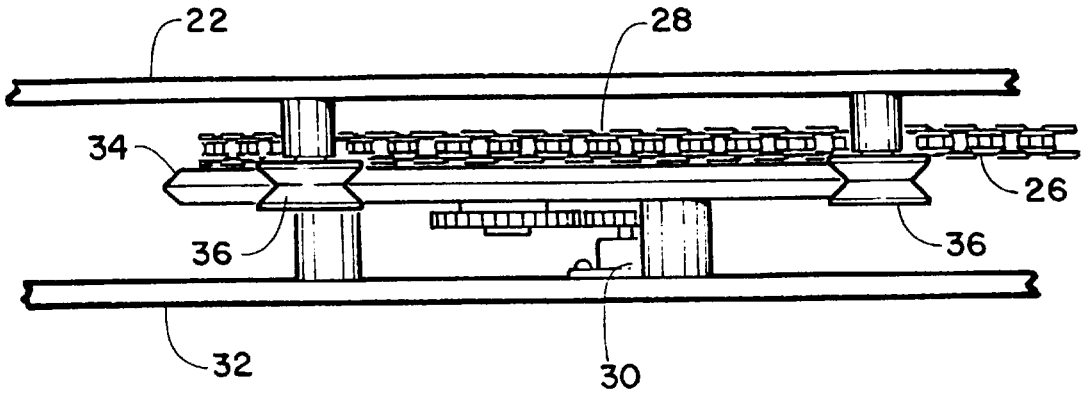
FIG. 2 is a frontal view of the apparatus without the antenna attached showing the antenna support housings attached to the base support member which is attached to the base plate.

FIG. 2 is a side view of the base rotation hub showing the base plate 32 having the circular hub 34 mounted thereon. The concave hub guides 36 are notched at their circumference in a manner to receive the circumference of the circular hub 34 in an operational relationship and they are mounted equidistant from each other upon the base support member in positions such that they engage the circumference of the circular hub 34 and rotate around it providing rotation ability to the base support member 22 and attached supports and antenna. The chain 26 shown in FIG. 1 provides rotation on demand by driving the gear 28 to reach the desired direction of the antenna 12.

Figure 3:
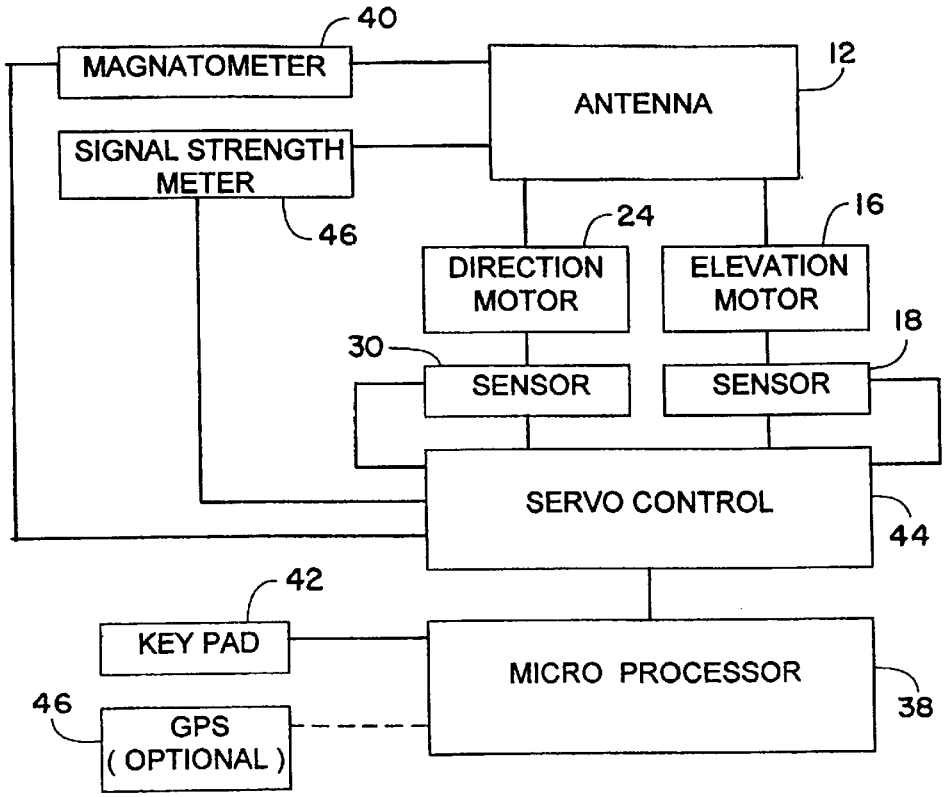
FIG. 3 is a side view showing the gear and concave hub guides attached to the bottom of the base support member and the hub attached to the base plate.
Figure 4:
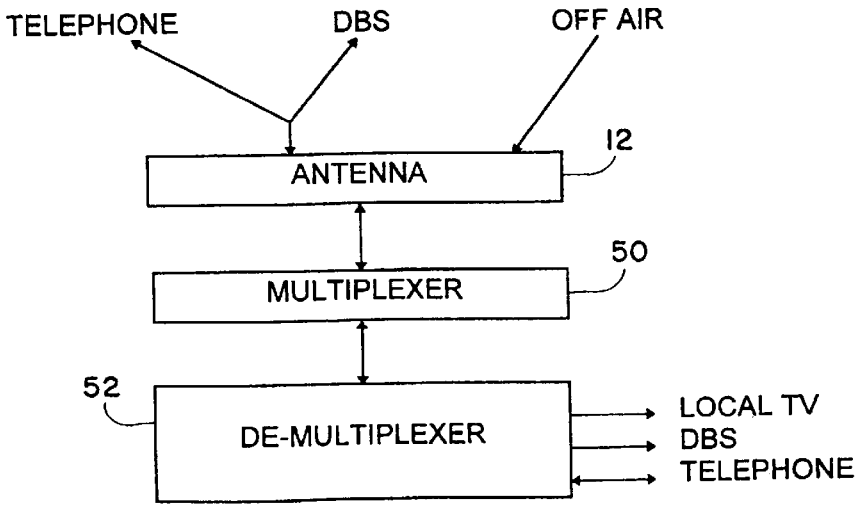
FIG. 4 is a top view of the gear and the concave hub guides attached to the base support member and showing the hub riding inside of the concave hub guides.

FIG. 3 is a box diagram of the aiming control for the apparatus. In operation with all on board electronic devices powered by a conventional power source such as a transformer with a voltage regulator (not shown), a conventional microprocessor 38 such as an Intel microprocessor board receives heading, pitch, and roll data from a conventional magnetometer 40 mounted on the apparatus and/or an accelerometer 41 in a manner to yield the pitch roll and heading location readings. The microprocessor 38 also receives data in the form of a keypad entry 42 from the user as to the desired satellite and the approximate apparatus location on the earth's surface from a number or letter coded map grid (not shown), which is provided to the user. Optionally, a conventional Global Positioning Satellite (GPS) signal from a conventional GPS device 44 as to the apparatus's longitudinal and latitudinal location on the earth's surface can be used in place of the user entered map grid location from the provided map grid.

Using the data regarding the antenna location and heading on the earth's surface and pitch and roll provided from the magnetometer 40 and 41 and also from a user entered information as to the desired satellite and estimated antenna apparatus location from a provided map grid, entered on the keypad 42 or from the optional GPS device 44, the preprogrammed microprocessor 38 calculates the correct elevation of the antenna, and directional heading for rotation of the base support for the antenna to be properly aimed at the desired earth orbiting satellite for communication therewith.

An elevation sensor 18, in this case a conventional potentiometer in communication with the antenna axis 14 communicates with both the microprocessor 38 and a microprocessor actuated conventional servo control board 44 the actual elevation of the antenna in real time. An azimuth sensor 30 which is in this case a conventional potentiometer, is in communication with the base support member 22 and also communicates with both the servo control board 44 and microprocessor 38 the direction the base support is pointing in real time.

The microprocessor 38 using on board preprogrammed software and algorithms, takes into consideration the map codes and satellite choices of the user, the data from the conventional magnetometer 40 and/or accelerometer 41 and calculates and then communicates to the servo control 44 the desired readings from both the elevation sensor 16 and azimuth sensor 30 at the point which the proper antenna direction and elevation are reached to communicate with the chosen satellite. The servo control board 44 therein energizes the elevation electric motor 16 and the azimuth electric motor 24 to achieve the desired direction and elevation of the antenna as confirmed by the real-time data provided by both the elevation sensor 18 and azimuth sensor 18.

The microprocessor 38 and servo unit 44, by continually measuring the output from both the elevation sensor 18 and azimuth sensor 30 can monitor the azimuth or direction and elevation in which the antenna is pointed in real time. Once the proper elevation and direction of the antenna to communicate with the desired satellite is reached, the servo unit 44 de-energizes the electric motors locking the antenna in the proper position for communication with the desired satellite.

A signal strength meter 46 continually updates the microprocessor 38 as to the signal strength being received from the satellite. If the signal strength drops below a preprogramed minimum, the preprogrammed microprocessor 38 will direct the servo control 44 to energize the elevation motor 16 and/or azimuth motor 24 to re-aim the antenna at the desired satellite to receive the strongest signal possible using provided heading and pitch and roll and location information from the magnetometer 40 and accelerometer 41 and GPS unit 46 to re adjust the aim of the antenna 12. By allowing for a variance in the software of the received signal to a predetermined minimum, constant and continuing adjustments of the antenna elevation and direction are minimized.

In addition, real time information regarding heaving, pitch, roll and heading of the antenna, can be continually provided to the microprocessor 38 by the on board magnetometer 40, and/or the accelerometer 41 and/or the GPS unit 46 for continuous real time updating of the optimum positioning of the antenna for satellite communication. In a rocking marine environment, this information would be used by the microprocessor 38 in conjunction with preprogrammed software and algorithms to direct the servo unit 44 to adjust the direction and elevation of the antenna though control of the respective electric motors controlling direction and elevation of the antenna. Such adjustments would be confirmed by readings from the elevation sensor 18 and azimuth sensor 30. This real time information provided by one or combinations of the magnetometer 40 the accelerometer 41 and the GPS unit 46 allow for continual adjustment of the elevation and direction of the antenna for the change in heading, pitch, and roll on a rocking boat or moving vehicle to maintain continual communication with the desired satellite.

Figure four depicts the reception and distribution of the satellite signals by the apparatus to various devices. The antenna 12 is a low profile, high gain, antenna able to receive Direct Broadcast Signals (DBS) from satellites and receive and transmit telephone signals from telephone satellites by using a broad band or multiple radiators or signal receivers attached to the antenna at the proper focal point on the antenna. Optionally, local or, off air, television channels can also be received through an off air UHF/VHF antenna incorporated into the antenna. Conventional Low noise amplifiers 48 for the different received signals may be used as required to boost signal strength.

In operation multiple signals are fed to first multiplexer 50 through one conventional coaxial cable thus alleviating the need for multiple wires to carry the different signals. A conventional slip ring type device (not shown) allows for the rotation of both the antenna and the base support member while maintaining the connections between the antennas and the multiplexer 50 through the conventional coaxial cable or other conventional wiring connecting them. Any conventional multiplexer can be used so long as it is capable of separating incoming signals into multiple channels of data and is capable in inverting polarity of the incoming signal. In addition a signal amplification device can also be included in the multiplexer unit 50.

The first multiplexer 50 feeds the received signals through a coaxial cable such as RG 59U cable, to a second multiplexer 52 which re-divides the signals and feeds them to the appropriate television, telephone, or DBS receiver requiring a signal.

In a transmit mode, transmit signals would be fed to the second multiplexor 52, through the coaxial cable to the first multiplexor 50 and broadcast to the desired satellite from the antenna 12. Such signals would normally be telephone communications however modem and digital communications are also possible depending upon the receiving satellite.

While all of the fundamental characteristics and features of the satellite antenna aiming device have been shown and described, it should be understood that various substitutions, modifications, and variations may be made by those skilled in the art without departing from the spirit or scope of the invention. Consequently, all such modifications and variations are included within the scope of the invention as defined by the following claims.

What is claimed is:

1. An satellite antenna aiming apparatus for use with electronic equipment requiring communication with earth orbiting satellites comprising:

an satellite antenna, a base plate;

a base support member said base support member rotatable upon a mount communicating with said base plate;

a first support mounting and a second support mounting both attached upon said base support member;

a first axil having two ends and a second axil having two ends, said first axil communicating at one end with said first support housing and at the other end with said satellite antenna;

said second axil communicating at one end with said first support housing and at the other end with said satellite antenna;

said satellite antenna rotatable between said first and second support housings upon said first axis and said second axis;

means for determining an optimum elevation and an optimum heading of said antenna;

means for elevation adjustment of said satellite antenna communicating with said first axil, whereby said first axil may be rotated thereby rotating said satellite antenna;

means for heading adjustment of said satellite antenna connected to said base member whereby said base member may be rotated thereby rotating said satellite antenna; and a controller, said controller communicating with said means for elevation adjustment and with said means for heading adjustment, said controller activating said means for elevation adjustment and said means for heading adjustment to maintain the optimum elevation and the optimum heading of said satellite antenna.

2. The invention as defined in claim 1 wherein said means for heading adjustment of said antenna is a base gear mounted to said base member, said base gear communicating with a first powered gear attached to a motor means whereby said base member may be rotated when said motor means rotates said first powered gear which rotates said base gear.

3. The invention as defined in claim 1 wherein said means for elevation adjustment of said antenna comprises an elevational gear mounted upon said first axil and communicating with a drive gear, said drive gear powered by and communicating with a second motor means, whereby elevation of said satellite antenna may be adjusted when said drive gear rotates said elevational gear thereby rotating said first axil and said satellite antenna.

4. The invention as defined in claim 1 further comprising:

means for continuous real time calculation of said optimum antenna elevation and said optimum antenna heading, said means for continuous real time calculation in communicating with said controller, whereby said controller maintains both of said means for elevation adjustment and said means for heading adjustment in said optimum elevation and said optimum heading while the antenna is moving.

5. The invention as defined in claim 1 wherein said means to determine said optimum elevation of said satellite antenna and said means for determine the optimum heading of said satellite antenna comprise:

a magnetometer;

a microprocessor communicating with said magnetometer; and software pre programmed into said microprocessor to calculate said optimum elevation and said optimum heading based on information received from said magnetometer.

6. The invention as defined in claim 1 wherein said means to determine said optimum elevation and said means for determine the optimum heading of said satellite antenna comprise:

an accelerometer;

a microprocessor communicating with said accelerometer; and software pre programmed into said microprocessor to calculate said optimum elevation and said optimum heading based on information received from said accelerometer.

7. The invention as defined in claim 1 wherein said means to determine said optimum elevation of said satellite antenna and said means for determine the optimum heading of said satellite antenna comprise:

a keypad for entering pre determined position codes;

a microprocessor communicating with said keypad; and software pre programmed into said microprocessor to calculate said optimum elevation and said optimum heading based on information received from said keypad.

8. The invention as defined in claim 1 wherein said means for determine said optimum elevation and said means for determine said optimum heading for said satellite antenna comprise:

an accelerometer;

a keypad for entering pre determined position codes;

a magnetometer;

a microprocessor communicating with said accelerometer and said keypad and said magnetometer;

a global positioning satellite locator; and software pre programmed into said microprocessor to calculate said optimum elevation and said optimum heading based on information received from said accelerometer and said keypad and said magnetometer and said global positioning satellite locator.

9. The invention as defined in claim 8 wherein said means for continuous real time calculation of said optimum elevation and said optimum heading of said satellite antenna comprise:

an accelerometer;

a keypad for entering pre determined position codes;

a microprocessor communicating with said accelerometer and said keypad; and software pre programmed into said microprocessor to calculate optimum elevation and optimum heading based on information received from said accelerometer and said keypad and said magnetometer wherein said optimum elevation and said optimum heading are continually communicated to said controller causing said controller to engage said means for elevation adjustment and said means for heading adjustment to maintain said optimum elevation and said optimum heading.

10. The invention as defined in claim 8 further comprising:

a global positioning satellite locator in communication with said microprocessor; and said microprocessor receiving information for optimum elevation and heading calculation therefrom.

11. The invention as defined in claim 1 wherein said satellite antenna is a relatively flat rectangular shaped antenna.

12. The invention as defined in claim 1 wherein said satellite antenna is a parabolic dish.

13. The invention as defined in claim 1 further comprising: an UHF/VHF antenna located upon said satellite antenna for reception of local television and radio signals.

14. The invention as defined in claim 11 wherein said antenna is rotatable upon both of said axis to a position substantially parallel to said base for compact storage.

15. The invention as defined in claim 12 wherein said antenna is rotatable upon both of said axis to a position substantially parallel to said base for compact storage.

* * * * *